United States Patent [19]

Kobayashi

[11] Patent Number: 4,893,594

[45] Date of Patent: Jan. 16, 1990

[54] START-FUEL SUPPLY DEVICE IN INTERNAL COMBUSTION ENGINE FOR PORTABLE EQUIPMENT

[75] Inventor: Takeshi Kobayashi, Yokohama, Japan

[73] Assignee: Walbro Far East, Inc., Kawasaki, Japan

[21] Appl. No.: 273,890

[22] Filed: Nov. 21, 1988

[30] Foreign Application Priority Data

Dec. 1, 1987 [JP] Japan ..... 62-303806

[51] Int. Cl.[4] ..... F02M 1/08

[52] U.S. Cl. ..... 123/187.5 R; 123/180 P; 261/DIG. 8

[58] Field of Search ..... 123/187.5 R, 180 E, 123/180 P; 261/DIG. 8

[56] References Cited

U.S. PATENT DOCUMENTS 3,371,658 3/1968 Turner ..... 123/187.5 R
4,373,479 2/1983 Billingsley et al. ..... 123/187.5 R
4,508,068 4/1985 Tuggle et al. ..... 123/187.5 R
4,676,204 6/1987 Inoguchi et al. ..... 123/180 P

FOREIGN PATENT DOCUMENTS 59-54758 3/1984 Japan ..... 123/187.5 R

*Primary Examiner*—Andrew M. Dolinar
*Attorney, Agent, or Firm*—Barnes, Kisselle, Raisch, Choate, Whittemore & Hulbert

[57] ABSTRACT

Start-fuel supply device in an internal combustion engine for portable equipment characterized in that a fuel nozzle is disposed at an intake passage of a diaphragm type carburetor, a fuel reservoir is connected to the metering chamber of the diaphragm carburetor through a check valve, a fuel metering device, a reversible primer pump, and a passage between the check valve and the fuel metering device connected to the fuel nozzle via a second check valve which allows a flow to the fuel zozzle. The fuel metering device includes a plunger and a check valve in the plunger opened and closed by the movement of the plunger.

7 Claims, 4 Drawing Sheets

START-FUEL SUPPLY DEVICE IN INTERNAL COMBUSTION ENGINE FOR PORTABLE EQUIPMENT

REFERENCE TO RELATED APPLICATIONS

Reference is made to the following filed United States applications which are assigned to an assignee common to the present application:

Ser. No. 237,964 Filed Aug. 29, 1988
Ser. No. 238,286 Filed Aug. 29, 1988
Ser. No. 273,891 Filed Nov. 21, 1988

FIELD OF INVENTION

The present invention relates to a start-fuel supply device in internal combustion engines for portable equipment.

BACKGROUND OF THE INVENTION

A small two-cycle internal combustion engine used as a driving source for portable equipment such as a chain saw, a brush cutter and the like is equipped with a diaphragm type carburetor so that excellent operation of the internal combustion engine may be controlled in any attitude.

As disclosed in Japanese Patent Application Laid-Open Publication No. 35047/1987, there is proposed an arrangement wherein when the engine is started, fuel is supplied from a fuel tank to a metering chamber by a manual primer pump, the fuel being also directed to fill an accumulator chamber. A button of an accumulator is operated simultaneously with the pull start operation of the engine to move the fuel in the accumulator through a fuel nozzle to an air intake passage of a carburetor. However, recently, internal combustion engines have been equipped with a battery driven starter motor mounted on the aforementioned portable equipment. It has become desirable that a power supply for driving the starter motor is also utilized to automatically perform a series of operations.

In view of the foregoing, reference is again made to pending U.S. application Ser. No. 237,964 in which there is disclosed an arrangement wherein a fuel reservoir formed from a resilient container is provided between a volume type primer pump and a fuel tank, whereby during the normal rotation of the primer pump, fuel in the metering chamber is replenished to the fuel reservoir by the primer pump and extra fuel is returned to the fuel tank, while, during the reverse rotation of the primer pump, the fuel in the fuel reservoir is injected as a start-fuel through a resiliently deformed portion of the fuel reservoir to an intake passage of a carburetor.

However, in this start-fuel supply device, the start fuel is metered by the resilient deformation of the fuel reservoir, and, therefore, the resilient deformation gives rise to unevenness due to the difference of the strength of resiliency, size and shape of the fuel reservoir, and the suction force of the primer pump, and the like. It has been found from the above-described fact to be difficult to accurately meter the start fuel as required. Furthermore, when a switch of the battery operated starter motor is turned off after the engine has been started, the primer pump operatively associated therewith also stops but the check valve remains closed, and therefore, fuel in the primer pump is returned through the expansion of the fuel reservoir and a small amount of fuel flows into the fuel reservoir.

At the time of restarting the engine immediately after the operation of the engine has been terminated, no start fuel is required. However, the temperature of the engine sometimes is not so high that the temperature switch is actuated, in which case, when the starter motor is driven, the primer pump is reversely rotated with the result that a small amount of start fuel remaining in the fuel reservoir is injected out of the fuel nozzle, which sometimes deteriorates the startability. If the engine is well heated, the temperature switch is opened so that the primer pump is not reversely rotated, and the start fuel is not supplied. That is, in the aforementioned device, a reaction in a temperature region where the temperature switch is closed cannot be made immediately after the operation of the engine has been terminated, and, therefore, the small amount of the start fuel remaining in the fuel reservoir is injected out of the fuel nozzle every time the starter cell motor is driven.

BRIEF DESCRIPTION OF THE DRAWINGS

DRAWINGS accompany the disclosure and the various views thereof may be briefly described as.

BRIEF DESCRIPTION OF THE INVENTION

Figure 1:
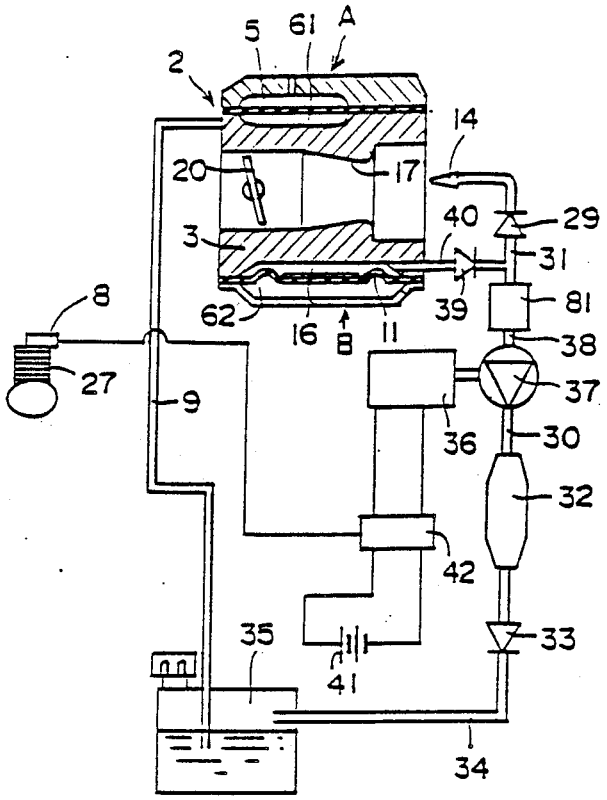
FIG. 1, an entire structural view of a start-fuel supply device in internal combustion engines for portable equipment according to the present invention.

It is an object of the present invention to provide a start-fuel supply device in an internal combustion engine for a portable equipment in which the start fuel is accurately metered, and once the start fuel has been injected, additional fuel is not injected even if the primer pump is reversely rotated.

For achieving the aforesaid object, the present invention provides a fuel nozzle that is disposed on an intake passage of a diaphragm type carburetor, a fuel reservoir is connected to a metering chamber through a check valve, a fuel metering device and a primer pump, and a passage between the check valve and the fuel metering device is connected to the fuel nozzle via the check valve which allows a flow to the fuel nozzle.

During the normal rotation of a primer pump 37, fuel in a metering chamber 16 flows into the primer pump 37, a fuel reservoir 32 and a fuel tank 35 through the interior of a plunger 87 of a fuel metering device 81. At that time, the plunger 87 is raised. A jet bore 91 provided in a passage of the plunger 87 adjusts the suction force of the primer pump 37 on the plunger 87 to prevent a fuel vapor from being generated in the metering chamber 16 due to the excessive pressure drop.

During the reverse rotation of the primer pump 37 operatively connected to the starter cell motor 46, fuel pressure from the primer pump 37 causes a check valve 95 to close and causes a plunger 87 to be forced downward. At that time, fuel in a metering chamber 92*b* under the plunger 87 is injected out of fuel nozzle 14. When the plunger 87 is forced downward, the plunger 87 comes into close contact with a seal member 93, and even if the primer 37 is further reversely rotated, no start fuel flows. Thereafter, even if the starter motor 46 is driven for re-starting, no start fuel is injected since the plunger 87 has been moved downwardly.

DETAILED DESCRIPTION OF THE INVENTION AND THE MANNER AND PROCESS OF USING IT

FIG. 1 shows a schematic structure of a start-fuel supply device in an internal combustion engine according to the present invention. The start-fuel supply device comprises a fuel metering device 81, a volume type primer pump 37 such as a gear pump or a vane pump normally and reversely rotated by a primer motor 36, a fuel reservoir 32 disposed between the primer pump 37 and a fuel tank 35, and a fuel nozzle 14 disposed in an air intake passage 17 of a carburetor 2. Upon energization by a battery 41 through a control device 42, the motor 36 is normally or reversely rotated. In the case where injection of the start-fuel from the fuel nozzle 14 is not needed, the reverse rotation of the motor 36 is impeded by a signal from a temperature switch 8 disposed on the external portion of the engine 27.

The carburetor 2 is provided at the upper portion with a fuel pump A in which a pulsating pressure introduced into chamber 5 and a pump chamber 61 are defined by a diaphragm 6 (FIG. 2), and at the lower portion with a fuel supply mechanism B in which a metering chamber 16 and an atmospheric chamber 62 are defined by a diaphragm 11. In the normal operation of the engine, fuel in the fuel tank 35 is drawn into the fuel pump A via a pipe 9 and then sent to the metering chamber 16. Fuel in the metering chamber 16 is drawn into the air intake passage 17 via a fuel jet, not shown, by the intake negative pressure of the air intake passage 17.

When the primer pump 37 is normally rotated to supply fuel to the metering chamber 16, prior to starting the engine, the fuel in the metering chamber 16 is drawn into the primer pump 37 via the passage 40, the check valve 39, the fuel metering device 81 and the passage 38, and thence passes into the passage 30 and the fuel reservoir 32. Surplus fuel is returned to the fuel tank 35 via the check valve 33 and the pipe 34. In this manner, when the metering chamber 16 assumes a negative pressure state, fuel in the fuel tank 35 passes through the pipe 9 and is supplied to the metering chamber 16 via the pump chamber 61 of the fuel pump A and a passage, not shown.

When the primer pump 37 is reversely rotated simultaneously with the starter motor action to start the engine, fuel in the reservoir 32 is drawn into the primer pump 37 via the passage 30 and thence supplied to the fuel metering device 81 through the passage 38. The start-fuel in the metering chamber **92*b* (FIG. 5) is injected through the fuel nozzle 14 to the air intake passage 17 via the passage 31 and the check valve 29**.

Figure 3:
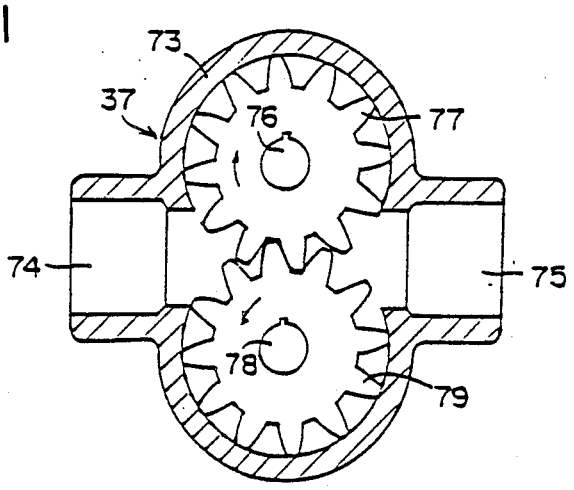
FIG. 3, a sectional plan view showing one example of a primer pump.

As shown in FIG. 3, a gear pump, for example, as the primer pump 37, has a casing 73 which accommodates therein gears 77 and 79 supported on shafts 76 and 78, respectively, meshing with each other, and if one of the shafts 76 and 78 is normally rotated (in a direction indicated by an arrow) by a primer motor 36 (FIG. 1), fuel is drawn through an opening 74 and discharged out of an opening 75 passing the outside of the gears 77 and 79.

Figure 4:
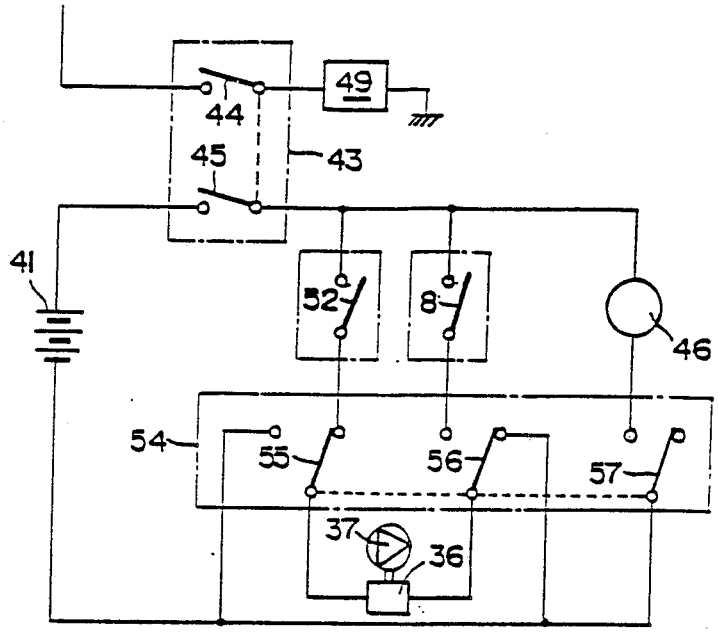
FIG. 4, a circuit view of a control device for the device.

FIG. 4 shows the detailed construction of a control device 42. A switch 44 for driving an ignition circuit 49 of the engine and a switch 45 operatively connected thereto are operated by a start key as a key switch 43. A fixed contact of the switch 45 is connected to a positive terminal of a battery 41 whereas a movable contact thereof is connected to fixed contact of a pump switch 52 and a temperature switch 8 and one terminal of a battery operated starter motor 46.

The movable contact of the pump switch 52 is connected to one fixed contact of a change-over switch 55, and the movable contact of the temperature switch 8 is connected to one fixed contact of a change-over switch 56. The motor 36 is connected between the movable contacts of the change-over switches 55 and 56. The other fixed contacts of the change-over switches 55 and 56 are connected to a negative terminal of the battery 41. The other terminal of the starter motor 46 is connected to a negative terminal of the battery 41 via a switch 57.

A start switch 54 composed of change-over switches 55 and 56 and a switch 57, operatively connected with each other, is normally in a state as shown, the start switch 54 being switched only during a period of the drive of the starter cell motor 46.

When the key switch 43 is closed and the pump switch 52 is closed, prior to starting the engine (prior to starting rotation of the engine), an energizing circuit is formed from the battery 41 to the switch 45, the pump switch 52, the change-over switch 55, the motor 36, the change-over switch 56 and the battery 41, whereby the motor 36 is normally rotated. Then, as described above, the primer pump 37, moves the fuel in the metering chamber 16 into the fuel reservoir 32 and fuel in the fuel tank 35 is supplied to the metering chamber 16.

Subsequently, when a start switch 54 is switched, an energizing circuit is formed from the battery 41 to the switch 45, the starter cell motor 46, the switch 57 and the battery 41, whereby the starter motor 46 is driven.

In the state where the ambient temperature of the engine is a temperature at which starting is difficult (at cold season), the temperature switch 8 remains closed, and therefore, an energizing circuit comprising the battery 41, the switch 45, the temperature switch 8, the change-over switch 56, the motor 36, the change-over switch 55 and the battery 41 is formed whereby the motor 36 is reversely rotated. Thereby start fuel in the fuel metering device 81 is injected from the fuel nozzle 14 to the air intake passage 17 of the carburetor 2. In this way, the engine is started, and when the start switch 54 is returned to the illustrated state, the motor 36 and the starter motor 46 stop.

Figure 2:
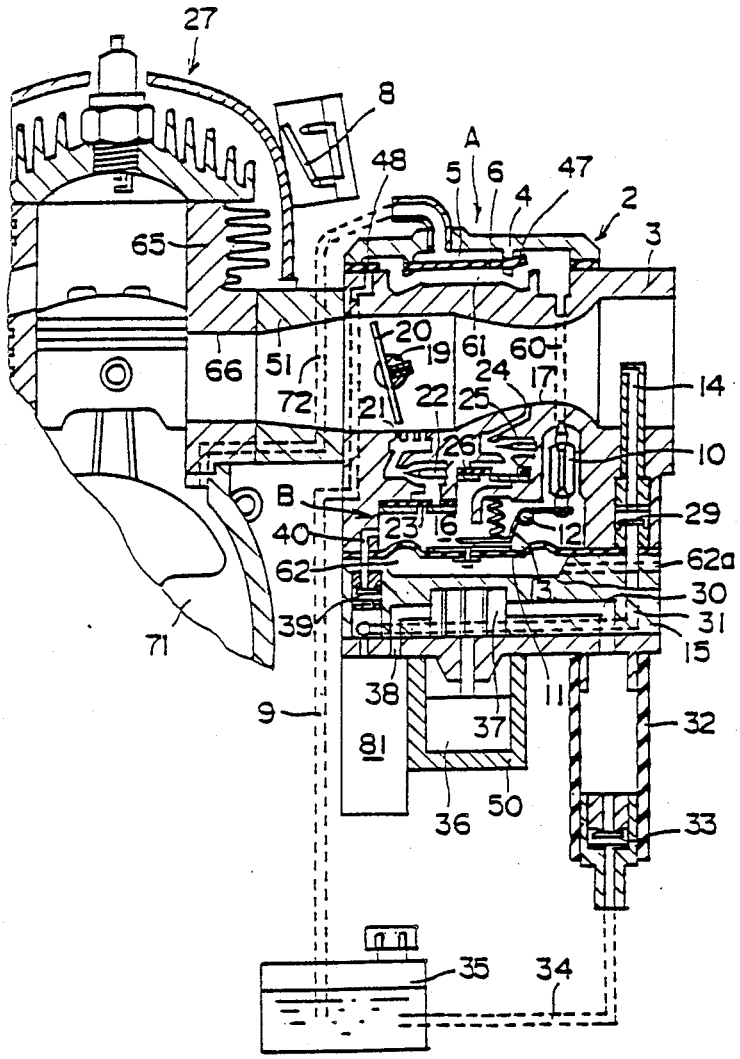
FIG. 2, a sectional side view showing the detailed construction of the device.

FIG. 2 shows the mounting state of the carburetor 2 integrally provided with the fuel metering device 81, the primer pump 37, the fuel reservoir 32 and the fuel nozzle 14 to the engine 27. On the side wall of a cylinder 65 of the engine 27 is mounted the diaphragm type carburetor 2 and an air cleaner (not shown) through an intake pipe 51 formed of a heat insulating material. A pipe 9 from the fuel tank 35 is connected to an inlet side of the fuel pump A of the carburetor 2.

In the carburetor 2, the air intake passage 17 including a venturi of the body 3 is communicated with an intake port 66 provided in a cylinder 65. Interiorly of the air intake passage 17 a well-known throttle valve 20 is rotatably supported by a valve shaft 19.

A cover 4 is coupled to the upper wall of the body 3 with a diaphragm 6 disposed therebetween, and a cover 15 is coupled to the lower wall with a diaphragm 11 disposed therebetween. The cover 4 is provided with a pulsating pressure introducing chamber 5, which is connected to a crank chamber 71 of the engine 27 through a pipe 72. A pump chamber 61 defined by the diaphragm 6 is connected to a pipe 9 via a check valve 48, and is also connected to the metering chamber 16 via a check valve 47, a passage 60 and an inlet valve 10.

An atmospheric chamber 62 between a diaphragm 11 defining the metering chamber 16 and a cover 15 is opened to the atmosphere by a passage 62*a*. The inlet valve 10 in the form of a needle valve is disposed on the end of the passage 60 and is opened and closed by a lever 13 supported on the wall of the metering chamber 16 by a shaft 12. One end of the lever 13 is biased into engagement with the end of the inlet valve 10 by means of the force of a spring. The other end of the lever 13 is forced in abutment with a projection coupled to an approximate center of the diaphragm 11. The metering chamber 16 is connected to a high-speed fuel jet 24 via a check valve 26 and a high-speed fuel metering needle valve 25. The metering chamber 16 is connected to a low-speed fuel jet 21 via check valve 23 and a low-speed fuel metering needle valve 22.

The cover 15 has coupled thereto a housing 50 on the underside of the cover 15 which accommodates the primer motor 36 coupled to the shaft of the primer pump 37. The primer pump 37 is accommodated within the housing integral with the cover 15.

One opening (an inlet at the time of normal rotation) of the primer pump 37 is connected to the metering chamber 16 via a passage 38, a fuel metering device 81, a check valve 39 and a passage 40. The other opening (an outlet at the time of normal rotation) of the primer pump 37 is connected to a fuel reservoir 32 formed of a flexible tube via a passage 30. The fuel reservoir 32 is connected to a fuel tank 35 via a check valve 33 coupled to the lower end thereof and a pipe 34.

The fuel reservoir 32, provided between the primer pump 37 and the fuel tank 35, is shaped as a pipe formed of rubber or vinyl. When the primer pump 37 is reversely rotated and fuel in the fuel reservoir 32 is drawn into the primer pump 37, the check valve 33 is closed to prevent a backflow of fuel from the fuel tank 35.

One opening of the primer pump 37 is connected to the fuel nozzle 14 via the passage 38, the fuel metering device 81, the passage 31 and the check valve 29 disposed interiorly of the body 3. The fuel nozzle 14 is disposed in an approximate center of the inlet side of the air intake passage 17, a jet of which is directed toward the downstream of the air intake passage 17.

Figure 5A:
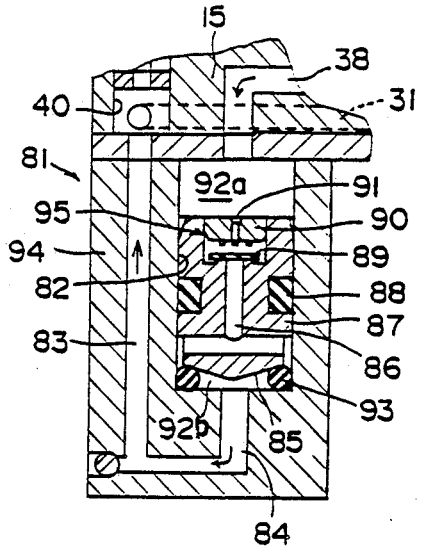
FIGS. 5(*a*) and 5(*b*), sectional side views showing the operating states of the device.
Figure 5B:
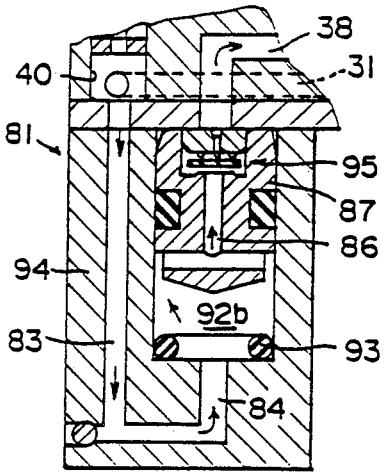

The fuel metering device 81 is coupled to the underside of the cover 15. As shown in FIG. 5(*a*), in the fuel metering device 81, a plunger 87 is fitted into a cylinder 82 of a body 94, and a chamber 92*a* is defined in the upper side thereof and a metering chamber 92*b* defined in the lower side thereof. The chamber 92*a* is connected with the primer pump 37 via a passage 38. The metering chamber 92*b* is connected with the metering chamber 16 via the passages 84, 83, the check valve 39 and the passage 40, and is also communicated with the fuel nozzle 14 via the passages 83, 31, and the check valve 29 (FIG. 2).

A seal ring 88 to secure a liquid-tightness with the cylinder 82 is mounted on the plunger 87 which has an ensmalled conical lower end 85 placed to engage an abutment with a seal member 93 fitted into the cylinder 82. A check valve 95 is provided on the upper end of the plunger 87. A valve seat insert 90 having a jet bore 91 is fitted into an open end of a cylindrical valve chamber, and a movable valve body 89 in the form of a disk formed of rubber or the like is accommodated within the valve chamber. The valve chamber in which the valve 89 is housed communicates with the metering chamber 92*b* via the axial passage 86, the diametrical passage below passage 86 and the lower ensmalled diameter portion of the plunger 87. The valve body 89, when pressed down towards the upper end of the passage 86, cuts off communication between the chamber 92*a* and the metering chamber 92*b*, whereas the valve body 89, when forced upward, impinges upon a plurality of projections provided on the surface encircling the jet bore 91 to connect the chamber 92*a* with the metering chamber 92*b*.

THE OPERATION

In the following, the operation of the start-fuel supply device in an internal combustion engine for a portable equipment according to the present invention will be described.

When the engine 27 is started, the switches 44 and 45 are closed, the starter motor 46 is energized and the pump switch 52 is closed so that the primer pump 37 is normally rotated by the prime motor 36. The fuel in the metering chamber 16 is drawn into the metering chamber 92*b* via the passage 40, the check valve 39, and the passages 83 and 84, and further drawn into the primer pump 37 via the passage 86 of the plunger 87, the check valve 95, the jet bore 91, the chamber 92*a* and the passage 38. The fuel is filled into the fuel reservoir 32 from the primer pump 37 via the passage 30. The extra fuel forces open the check valve 33 and is returned to the fuel tank 35 via the pipe 34. At that time, the plunger 87 is upwardly urged by the fluid resistance of the jet bore 91 and the suction force of the primer pump 37 to assume the state as shown in FIG. 5(*b*).

Next, when the pump switch 52 is opened and the start switch 54 is switched, the primer pump 37 is reversely rotated so that the fuel in the fuel reservoir 32 is drawn into the primer pump 37 via the passage 30. The fuel is fed from the primer pump 37 to the chamber 92*a* through the passage 38. The check valve 95 is closed by the fuel pressure, and the plunger 87 is forced downward to come into abutment with the seal member 93. At that time, the fuel in the metering chamber 92*b* is injected into the air intake passage 17 from the fuel nozzle 14 via the passages 84, 83 and 31 and the check valve 29. At the same time, the engine 27 is smoothly started by the starter cell motor 46.

When the primer pump 37 is reversely rotated, the fuel reservoir 32 is collapsed. When the primer pump 37 stops, the volume of the fuel reservoir 32 is expanded by the resilient restoring force. At that time, even if the fuel in the chamber 92*a* is slightly drawn to be returned, the plunger 87 remained unmoved. Accordingly, in the case where the engine is restarted by pushing the start switch 54 alone without closing the pump switch 52, even if the primer pump 37 is reversely rotated when the temperature switch 8 is closed, the start-fuel is not replenished to the metering chamber 92*b*, and therefore, the start fuel is not injected out of the fuel nozzle 14. This overcomes a problem that may exist when the engine is restarted immediately after the operation thereof has been terminated, and a mixture becomes rich due to the injection of unnecessary fuel from the fuel nozzle 14 to impair the smooth start of the engine.

The seal ring 88 of the plunger 87 has the liquid tightness and adequate resiliency with respect to the cylinder 82 to prevent the plunger 87 from being naturally moved downward to insure the accurate fuel metering.

A quantity of start fuel injected from the fuel nozzle 14 is determined according to the volume of the metering chamber 92*b* under the plunger 87. If the suction force is strong, the pressure in the metering chamber 16 abnormally lowers to sometimes generate a fuel vapor, and, therefore, the suction force of the plunger 87 is adjusted by the jet bore 91 provided in the plunger 87.

If the volume of the fuel reservoir 32 is made larger than that of the chamber 92*a* of the fuel metering device 81, the resiliently deforming force will not exert on the fuel reservoir 32, and the plunger 87 in its lower state is in the abutment with the seal member 93, and therefore, a small amount of start fuel is not injected whenever the starter cell motor 46 is started.

If the volume of the metering chamber 92*b* of the fuel metering device 81 is varied, an optimum amount of start fuel can be supplied to adjust to engines having a different displacement.

Actually, the fuel reservoir 32 need not be formed of a resilient material, and the check valve 33 need not be provided. However, when the fuel tank 35 assumes a positive pressure, a slight amount of fuel sometimes leaks from the shaft portion of the primer pump 37 and, therefore, the check valve 33 is preferably provided.

REVIEW OF THE OPERATION

As described above, according to the present invention, a fuel nozzle is disposed on an intake passage of a diaphragm type carburetor, a fuel reservoir is connected to a metering chamber through a check valve, a fuel metering device and a primer pump, and a passage between the check valve and the fuel metering device is connected to the fuel nozzle via the check valve which allows a flow to the fuel nozzle.

The fuel supplied from the metering chamber to the fuel reservoir via the fuel metering device during the normal rotation of the primer pump is returned to the fuel metering device during the reverse rotation of the primer pump to press down the plunger so that the start-fuel in the metering chamber under the plunger is injected from the fuel nozzle to the air intake passage and, therefore, a richer mixture is produced and the engine can be started easily.

Where the engine is restarted immediately after the operation thereof has been terminated, a few revolutions of the starter motor will suffice, in which case the start-fuel is not replenished to the metering chamber, and, therefore, even if the primer pump is reversely rotated, the start-fuel is not injected to avoid impairing of the start of the engine resulting from the production of unnecessarily richer mixture.

What is claimed is:

1. Start-fuel supply device in an internal combustion engine for portable equipment characterized in that a fuel nozzle is disposed at an intake passage of a diaphragm type carburetor, a fuel reservoir is connected to the metering chamber of the diaphragm carburetor through a check valve, a fuel metering device, a reversible primer pump, and a passage between the check valve and the fuel metering device connected to the fuel nozzle via a second check valve which allows a flow to the fuel nozzle.

2. Start-fuel supply device in internal combustion engine for portable equipment according to claim 1, wherein the fuel metering device comprises a plunger, a check valve opened and closed by the movement of the plunger, and a check valve which allows a flow of fuel from the metering chamber to the fuel reservoir.

3. Start-fuel supply device in internal combustion engine for portable equipment according to claim 2, wherein the plunger is moved forward by the flow of fuel from the metering chamber to the fuel reservoir during normal rotation of the primer pump, whereas the plunger is moved backward by the pressure of fuel from the fuel reservoir to the fuel metering device during the reverse rotation of the primer pump operatively connected to a starter motor, to feed the fuel in the metering chamber to the fuel nozzle.

4. Start-fuel supply device in internal combustion engine for portable equipment according to claim 3, wherein a jet bore for adjusting a fuel suction pressure of the metering chamber is provided in the plunger.

5. An apparatus for supplying start fuel to an internal combustion engine for a portable type working machine in which a diaphragm carburetor has an air-fuel mixing passage with an air inlet, a metering chamber with conventional main and idle ports, a fuel supply tank, and a fuel pump to move fuel from said tank to said metering chamber, characterized in

- a supplemental fuel nozzle directed to said air inlet,
- a volume fuel reservoir in a conduit between said fuel nozzle and said fuel tank,
- a reversible power driven primer pump associated with said conduit between said nozzle and said reservoir,
- a one-way connection between said metering chamber and said conduit, and
- a fuel metering means associated with said conduit between said pump and said nozzle and between said metering chamber and said pump to direct fuel from said metering chamber to said reservoir during rotation of said pump in one direction, while retaining a charge of start fuel and moving said charge to said fuel nozzle upon reverse rotation of said pump.

6. An apparatus as defined in claim 5 in which said fuel metering means comprises a plunger movable in a cylindrical recess, a check valve opened and closed by the movement of said plunger, and a restricted passage for directing fuel from one end of said plunger past said check valve to the other end and thence to the reservoir.

7. An apparatus as defined in claim 6 in which said restricted passage comprises a jet bore for controlling flow of fuel to said reservoir wherein during a restart immediately following engine operation, there is no start fuel charge accumulated in said fuel metering means.

* * * * *